US007844374B2

(12) United States Patent
Mizutani

(10) Patent No.: US 7,844,374 B2
(45) Date of Patent: Nov. 30, 2010

(54) WATERCRAFT STEERING SYSTEM

(75) Inventor: Makoto Mizutani, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 739 days.

(21) Appl. No.: 11/859,544

(22) Filed: Sep. 21, 2007

(65) Prior Publication Data

US 2008/0119974 A1 May 22, 2008

(30) Foreign Application Priority Data

Nov. 17, 2006 (JP) ..... 2006-312157

(51) Int. Cl.
*B63H 25/24* (2006.01)

(52) U.S. Cl. ..... 701/21; 701/36; 701/41; 701/110

(58) Field of Classification Search ..... 701/21, 701/36, 41, 51, 67, 70, 101, 104, 110; 114/144 E, 114/144 R, 144 RE; 440/1
See application file for complete search history.

(56) References Cited

U.S. PATENT DOCUMENTS 5,142,473 A * 8/1992 Davis ..... 701/21
2005/0199169 A1* 9/2005 Mizutani ..... 114/144 RE

FOREIGN PATENT DOCUMENTS

JP 04-038297 2/1992
JP 2959044 7/1999
JP 2005-254848 9/2005
JP 2006-069408 3/2006

OTHER PUBLICATIONS

U.S. Appl. No. 11/859,654, filed Sep. 21, 2007, entitled Watercraft Steering System.
U.S. Appl. No. 11/859,533, filed Sep. 21, 2007, entitled Watercraft Steering System.
U.S. Appl. No. 11/781,785, filed Jul. 23, 2007, entitled Steering System for Outboard Motor.
U.S. Appl. No. 11/853,731, filed Sep. 11, 2007, entitled Boat Steering System.

* cited by examiner

*Primary Examiner*—Richard M. Camby
(74) *Attorney, Agent, or Firm*—Keating & Bennett, LLP

(57) ABSTRACT

A boat has a propulsion unit and a steering system. The steering system includes a steering device actuated by an electric actuator. A steering wheel operated by an operator is electrically connected to the actuator. Detectors collect data regarding one or more of operation status of the steering wheel, running status of the boat, status of the propulsion unit, status of the electric actuator, and the like. In certain situations, the electric actuator may not be capable of providing a quick steering response. A controller weighs detected data to identify such situations and controls a propulsive force of the propulsion unit so as to restrain the propulsive force if necessary to maintain good steering response.

19 Claims, 11 Drawing Sheets

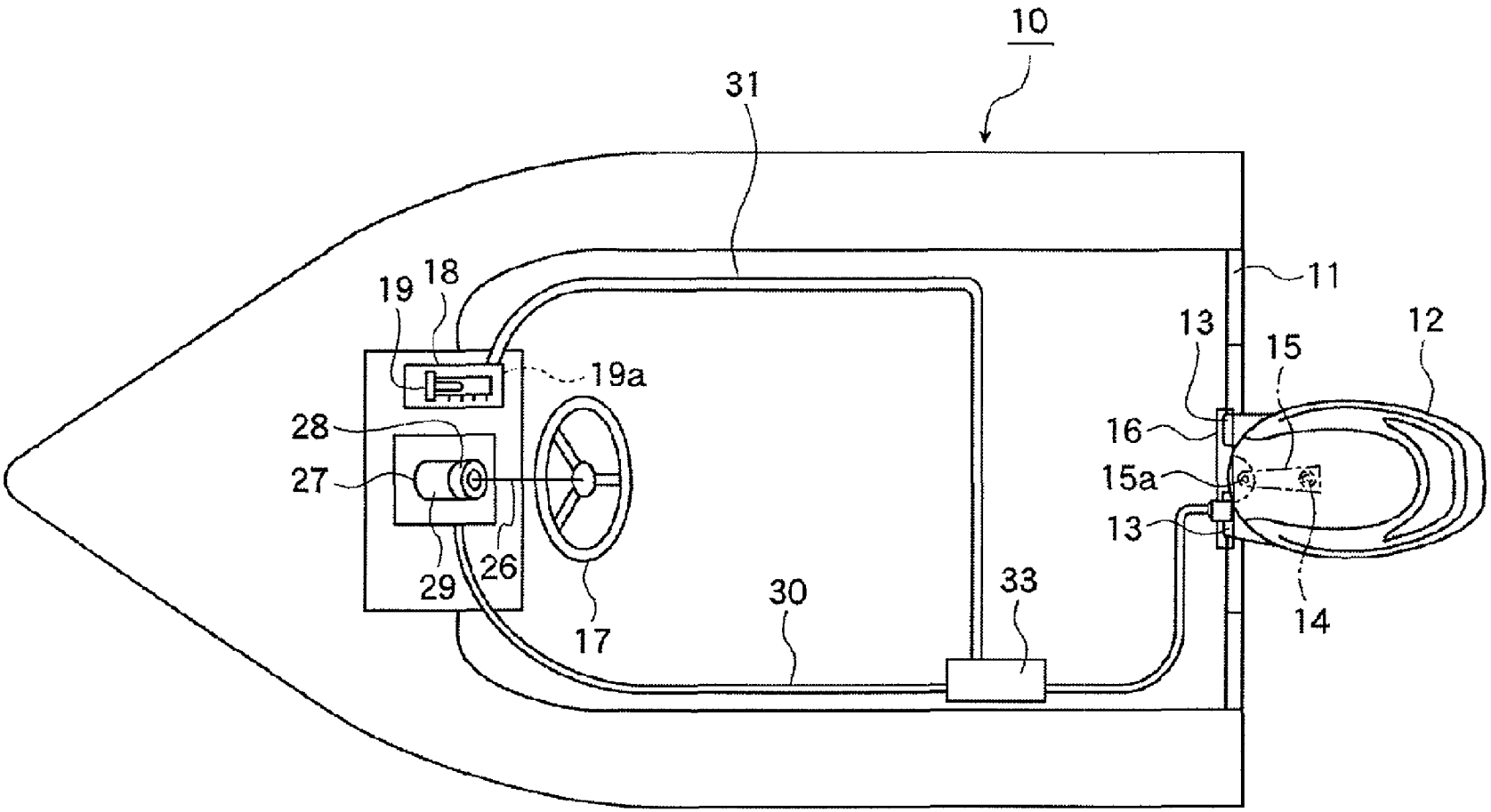
[FIG. 1]

[FIG. 2]
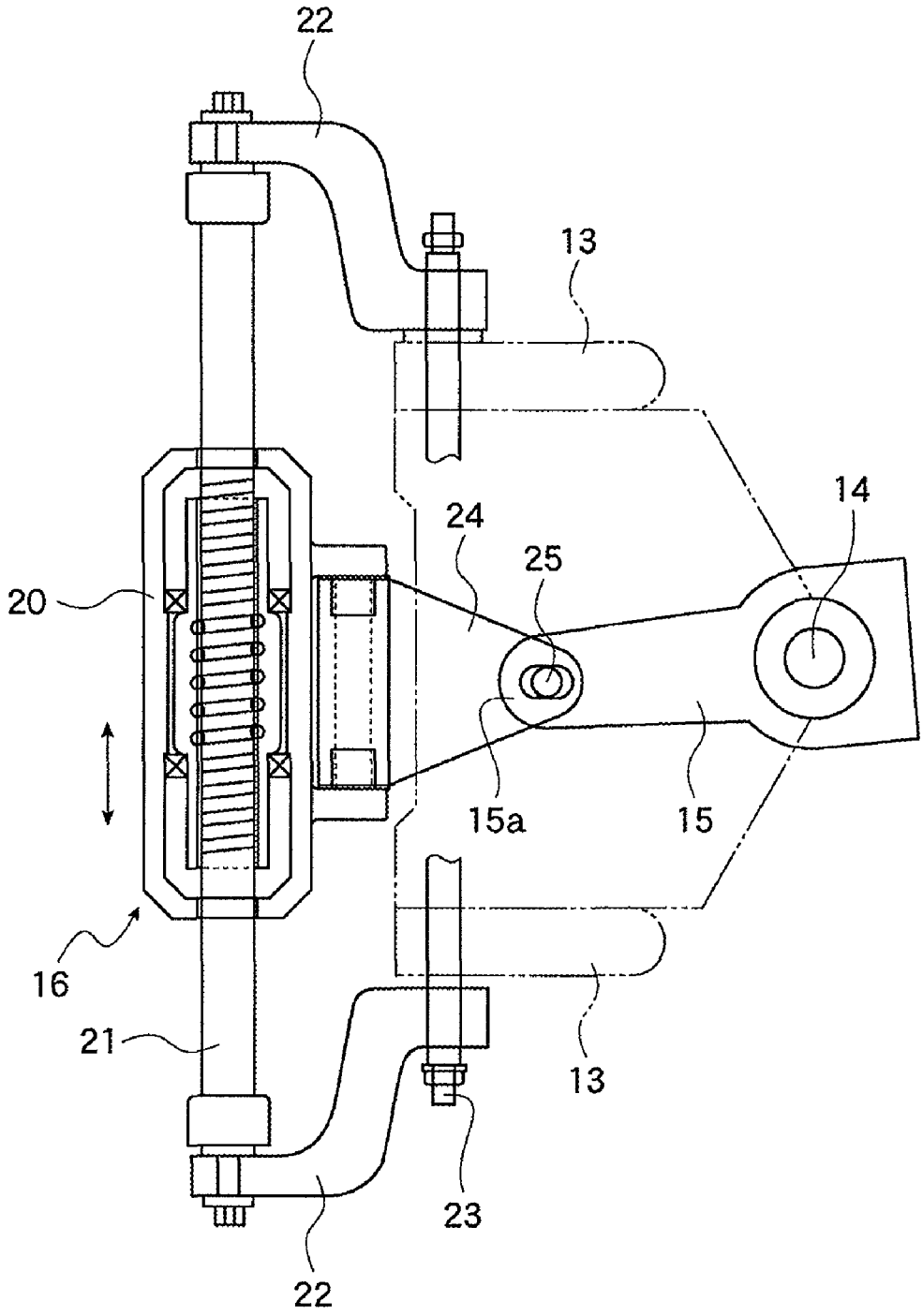

[FIG. 3]
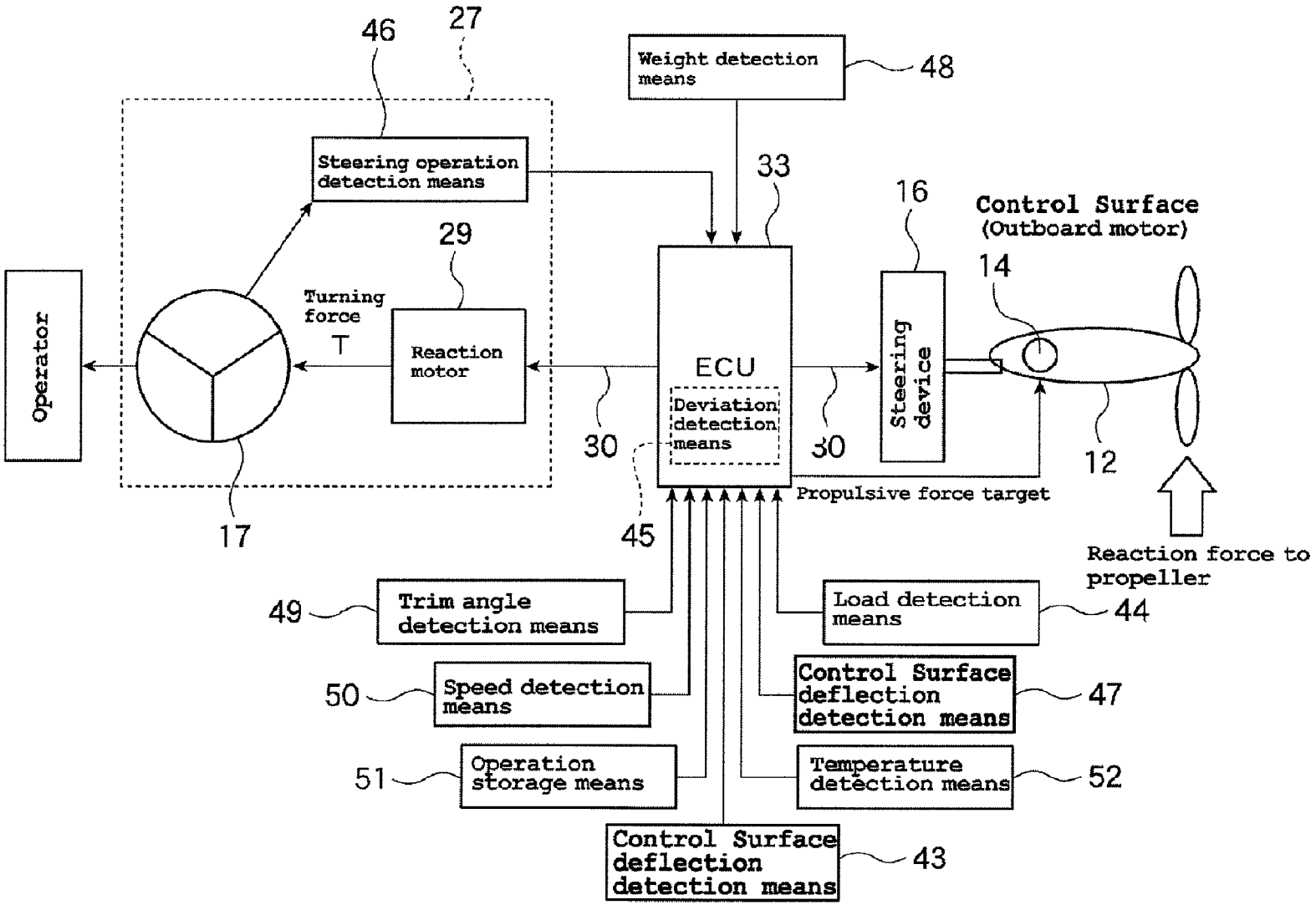

[FIG. 4]
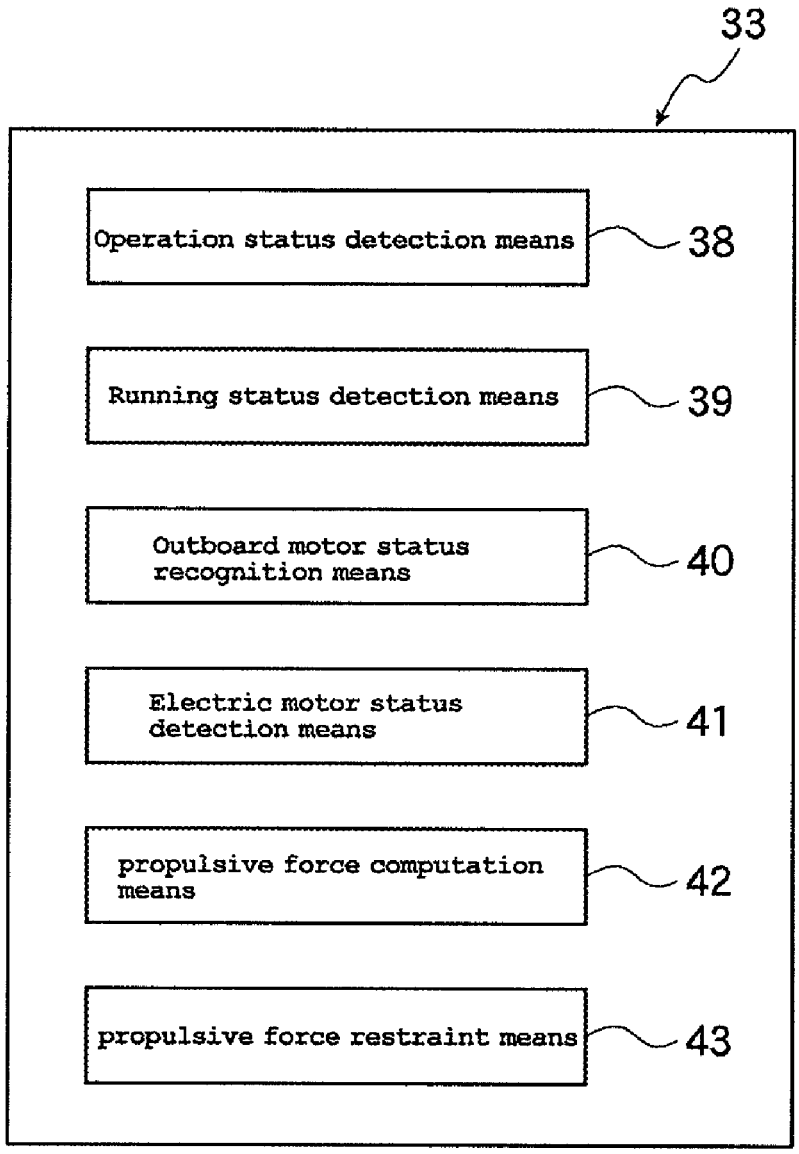

[FIG. 5]
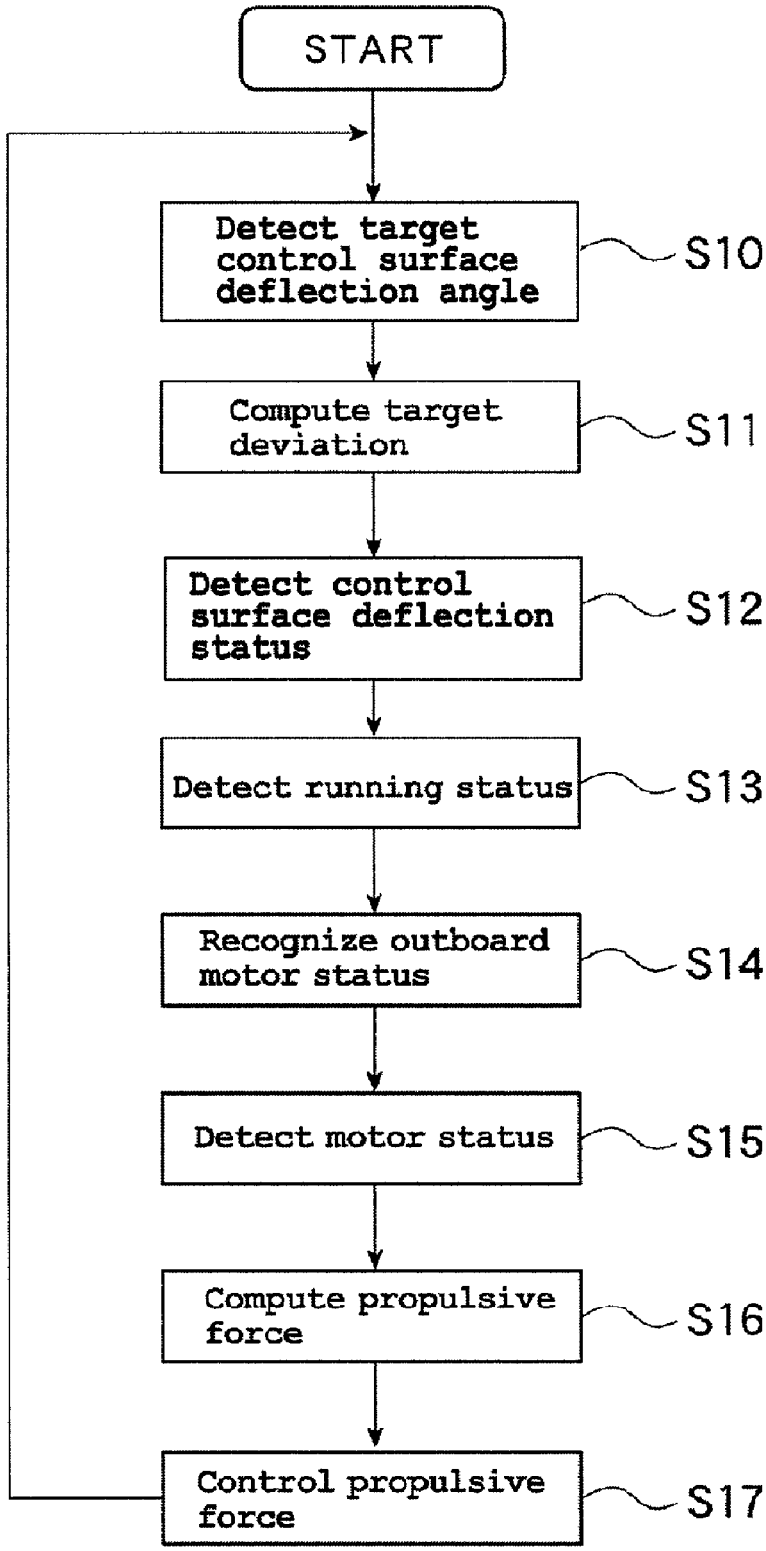

[FIG. 6]
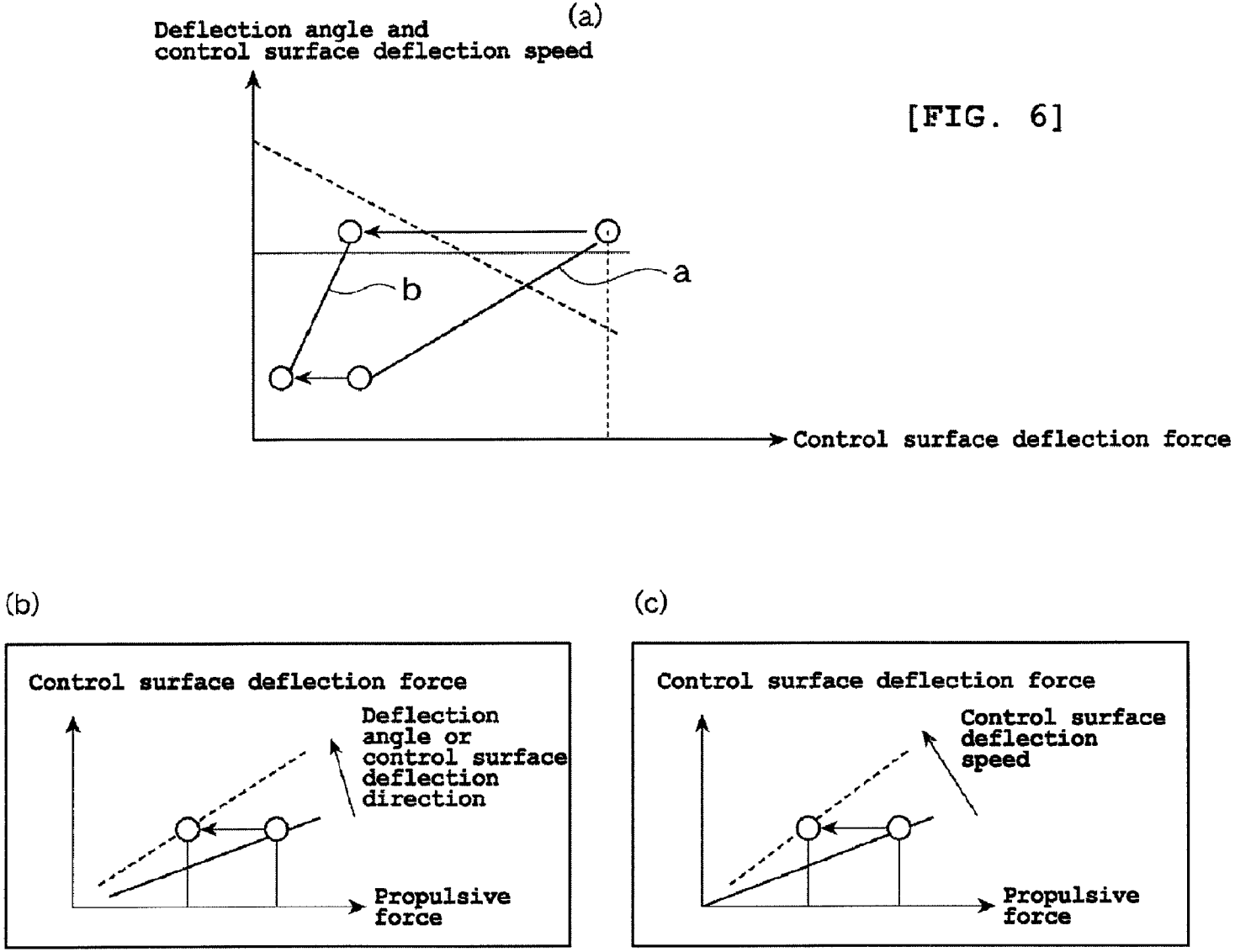

[FIG. 7]
(a)
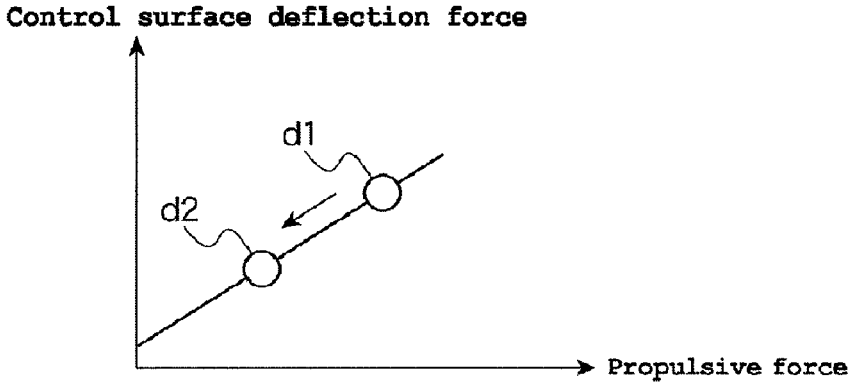
(b)
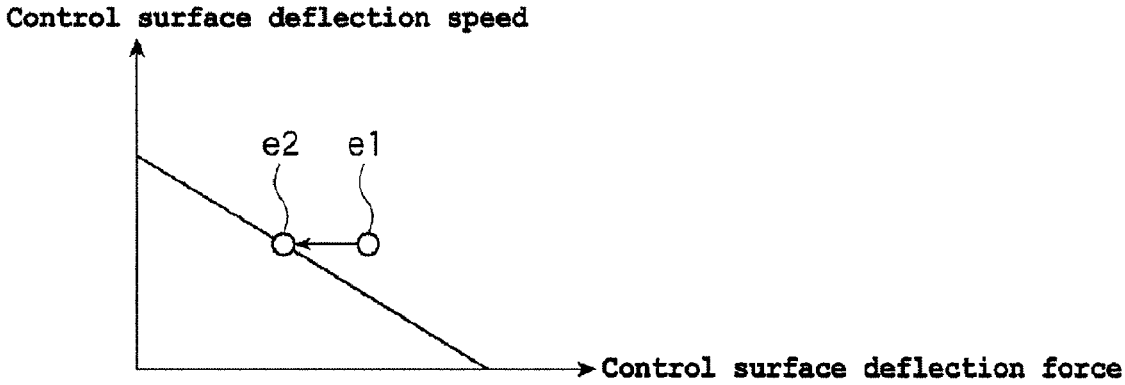
(c)
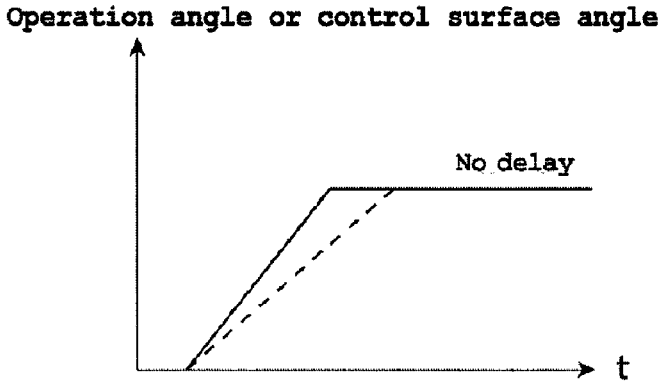

[FIG. 8]
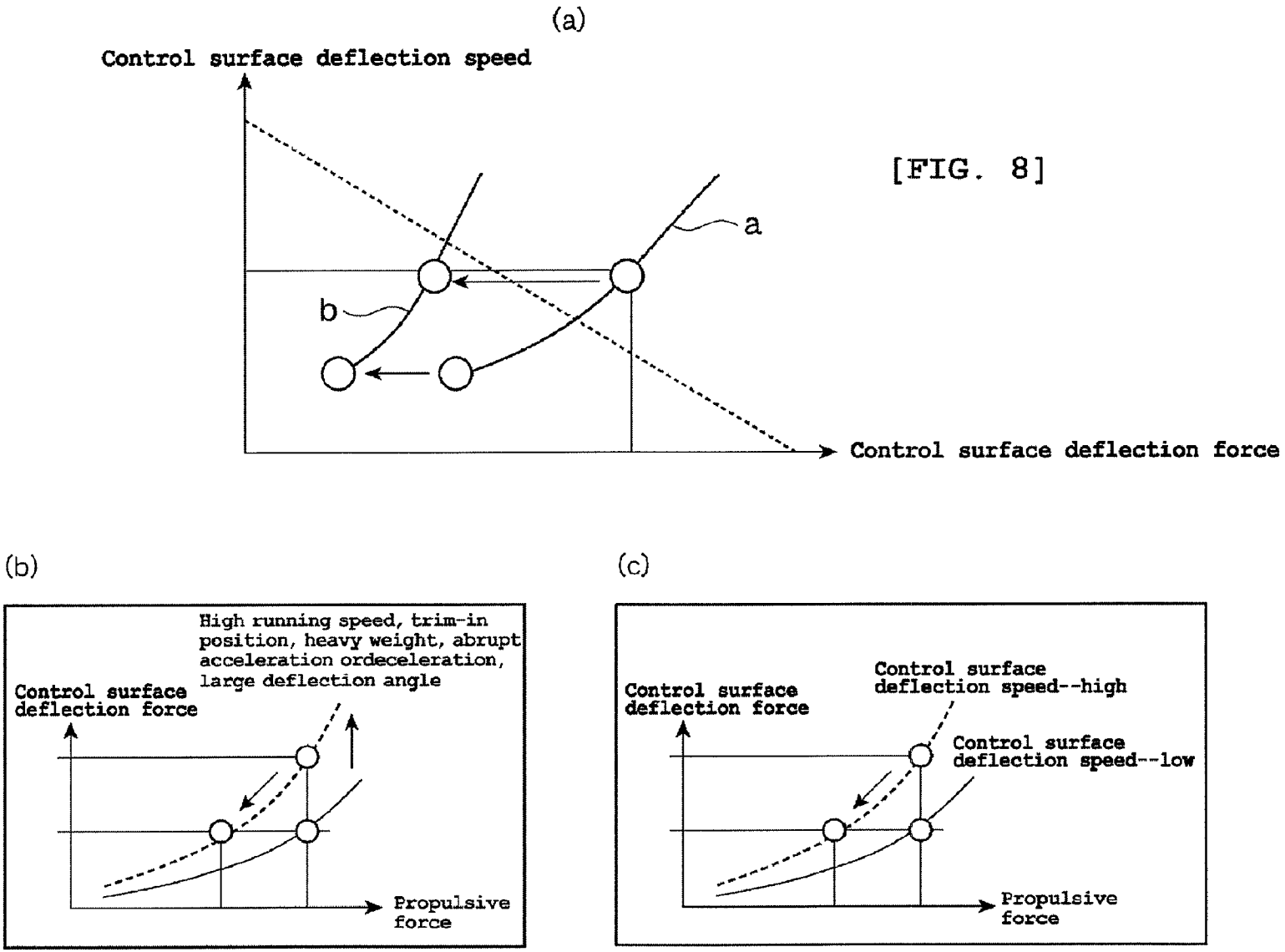

[FIG. 9]
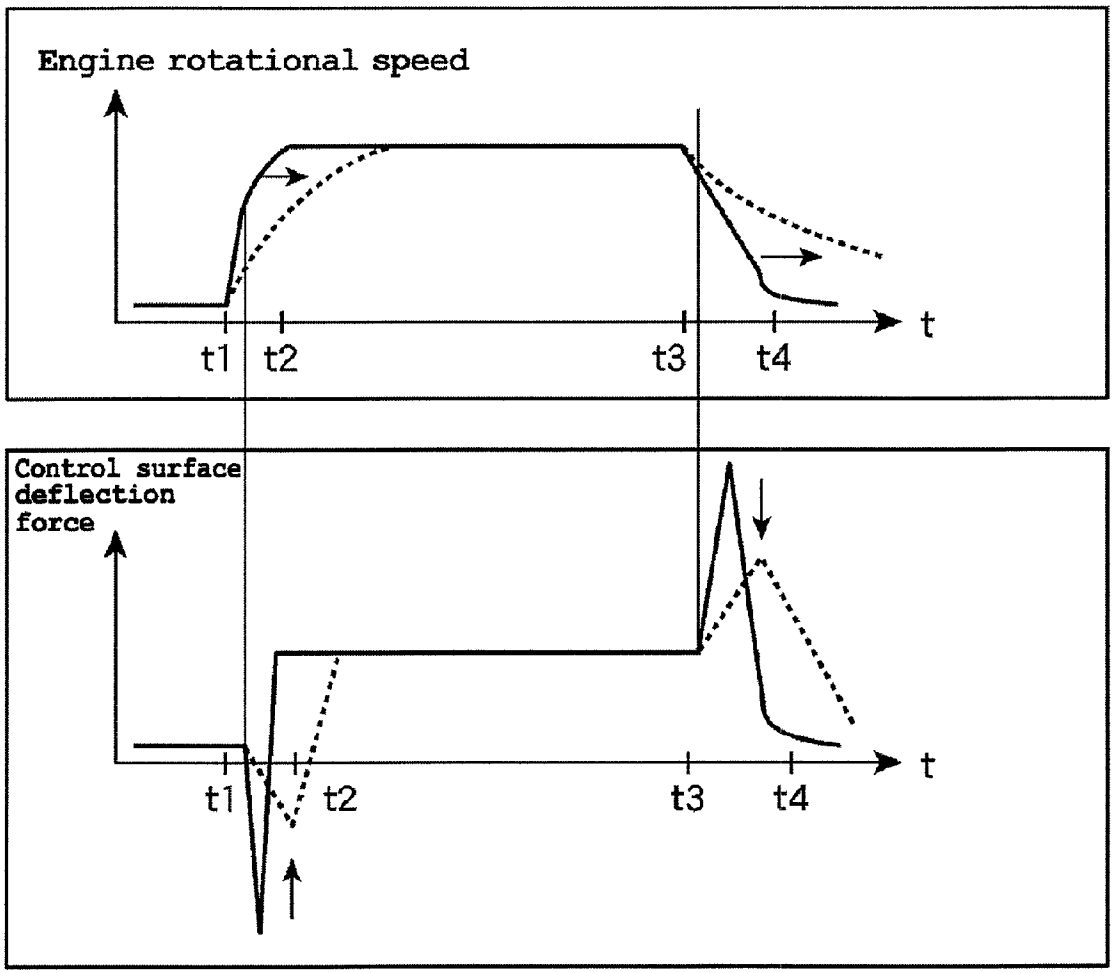

[FIG. 10]
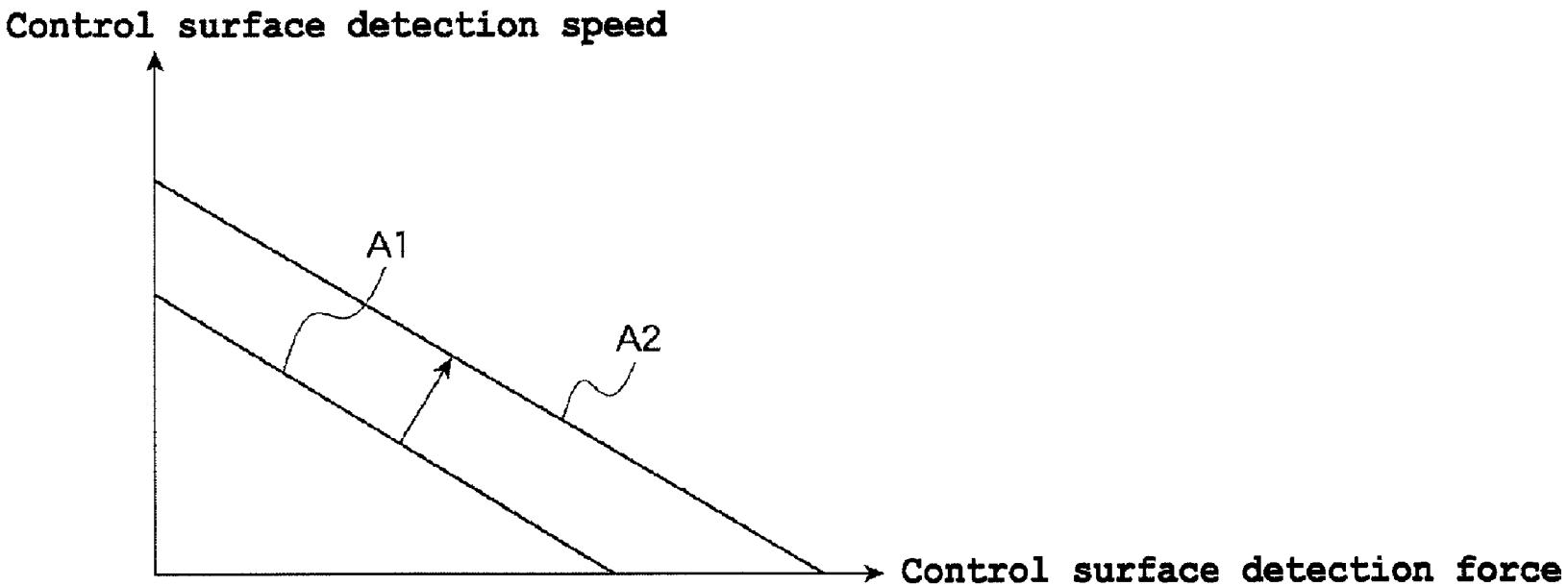

[FIG. 11]
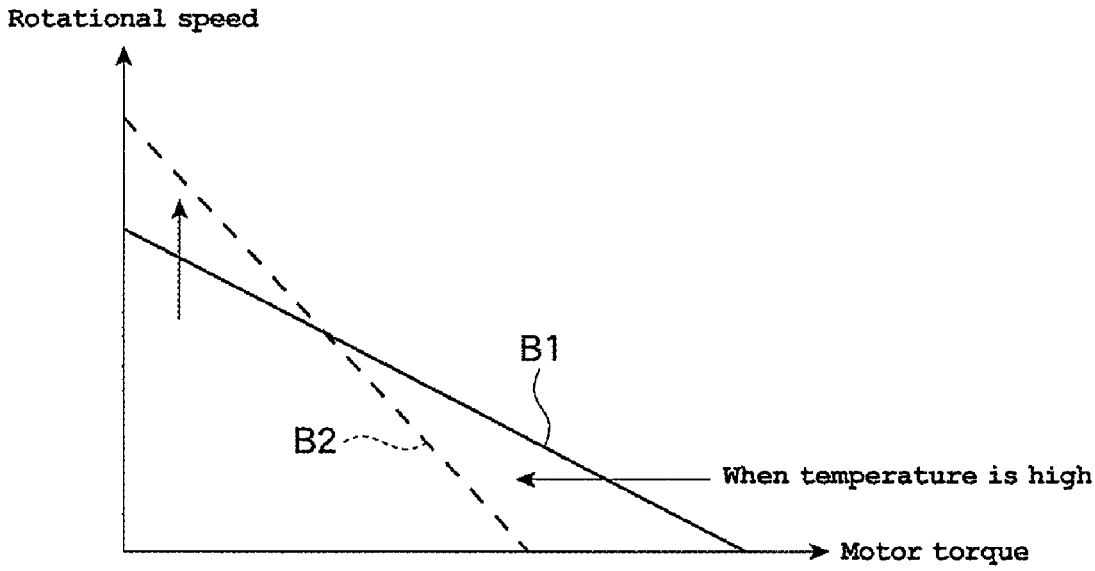

WATERCRAFT STEERING SYSTEM

CROSS-REFERENCE TO RELATED APPLICATIONS

The present application is based on and claims priority under 35 U.S.C. §119 to Japanese Patent Application Serial No. 2006-312157, filed on Nov. 17, 2006, the entire contents of which are expressly incorporated by reference herein.

BACKGROUND OF THE INVENTION

1. Field of the Invention

The present invention relates to a boat having a steering system that uses an electric actuator.

2. Description of the Related Art

In conventional boat, the boat is steered in response to operation of the steering wheel. Japanese Patent Document No. JP-A-2005-254848 discloses an electric actuator that is actuated as an operator operates the steering wheel. An external force to the boat is detected during such steering, and a reaction torque is applied to the steering wheel based on the detected external force. Accordingly, the operator can feel the external force to the boat due to, for example, a water current, directly through the steering wheel, and thus can recognize the movement of the boat corresponding to such external force so as to react quickly.

When such a boat is under no external force, an operation feel of the steering wheel can be lighter. Unfortunately, when larger output is required for control surface deflection (high control surface deflection torque), and when the steering wheel is operated faster, output from the steering motor (electric actuator) becomes less responsive, resulting in a poor operation feel.

It should be noted that control surface deflection torque characteristics sufficient to cause control surface deflection may change depending on a number of conditions. For example, FIG. 10 shows a change from control surface deflection force characteristic line A1 to control surface deflection force characteristic line A2, depending on conditions such as the characteristics of the boat, a control surface angle, an operation speed, or the like. During some conditions, a control surface deflection force may exceed the limit of the motor ability, resulting in impaired responsiveness and a poorer operation feel.

Further, as shown in FIG. 11, some motor characteristics depend on the surroundings such as temperature. For example, when the temperature becomes high the motor characteristics may change from the state shown by motor characteristic line B1 (solid line in the figure) to the state shown by motor characteristic line B2 (broken line in the figure). Since the motor characteristics at high temperatures provide lower torque, a control surface deflection force required may not be obtained during light temperature conditions, resulting in impaired responsiveness and a poorer operation feel.

SUMMARY

Accordingly, there is a need in the art for a boat having a steering system that provides excellent responsiveness in varying conditions and which provides excellent operation feel during control surface deflection, depending on a running status of the boat.

In accordance with a preferred embodiment, the present invention provides a boat having a propulsion unit and a steering system comprising a steering wheel and a steering device. The steering device comprises an electric actuator.

The steering wheel is operable by an operator and generates an actuation signal corresponding to steering wheel operation. The steering wheel is electrically connected to the electric actuator. The boat additionally comprises a controller adapted to control a propulsive force of the propulsion unit. The controller has at least one of an operation status portion adapted to obtain data concerning steering wheel operation, a running status portion adapted to obtain data concerning a running status of the boat, a propulsion unit status portion adapted to obtain data concerning a status of the propulsion unit, and an electric actuator status portion adapted to obtain data concerning a status of the electric actuator. The controller further comprises a propulsive force calculator adapted to calculate a propulsive force target based on data from at least one of the controller portions. The controller is configured to reduce or restrain the propulsive force of the propulsion unit to a level at or below the propulsive force target value.

In one embodiment, the operation status portion includes at least one of a control surface deflection force detector adapted to detect a control surface deflection force necessary to deflect a control surface of the boat, a load detector adapted to detect a load on the control surface, a steering operation detector adapted to detect a steering wheel operation angle, a steering wheel operation speed and a direction in which the steering wheel is operated, a control surface deflection detector adapted to detect a control surface deflection angle, a control surface deflection speed and a direction in which the control surface is deflected, corresponding to the steering wheel operation, and a deviation detector adapted to detect a deviation of a detected actual control surface deflection angle from a target control surface deflection angle corresponding to the steering wheel operation.

In another embodiment, the running status detector portion includes at least one of a weight detector adapted to detect at least one of a position of a waterline and a weight of the boat, a trim angle detector adapted to detect a trim angle of the boat, and a speed detector adapted to detect at least one of a speed and an acceleration of the boat.

In yet another embodiment, the propulsion unit status portion includes an operation storage adapted to store data concerning one or more of the installation number of the propulsion unit, an installation position of the propulsion unit relative to the boat, a rotational direction of a propeller of the propulsion unit, a propeller shape, a trim tab angle and a trim tab shape.

In a further embodiment, the electric actuator status portion includes a temperature detector adapted to detect a temperature of the electric actuator.

In a still further embodiment, the propulsion unit is an outboard motor.

In accordance with another preferred embodiment, the present invention provides a method of steering a boat comprising a propulsion unit, a steering wheel, and a steering system comprising an electric actuator adapted to deflect a control surface to effect steering. The method comprises obtaining an actuation signal corresponding to steering wheel operation, obtaining electronic data concerning at least one of a steering wheel operation, a running status of the boat, a status of the propulsion unit, and a status of the electric actuator. A propulsive force target is calculated based on the actuation signal corresponding to steering wheel operation and at least one of the electronic data. The propulsion unit is controlled so that a propulsive force of the propulsion unit is at or below the propulsive force target.

BRIEF DESCRIPTION OF THE DRAWINGS

FIG. 1 is a plan view of a boat in accordance with one embodiment.

FIG. 2 is an enlarged plan view of a steering device of the boat in accordance with the embodiment of FIG. 1.

FIG. 3 is a block diagram showing interactions of some systems and detectors in accordance with an embodiment.

FIG. 4 is a block diagram of aspects of an ECU in accordance with one embodiment.

FIG. 5 is a flowchart of a propulsive force control process in accordance with an embodiment.

FIG. 6 are graphs of a propulsive force control state depending on a control surface deflection status in accordance with an embodiment.

FIG. 7 are graphs showing effects of propulsive force control in accordance with an embodiment.

FIG. 8 are graphs of a propulsive force control state depending on a running status in accordance with one embodiment.

FIG. 9 are graphs showing certain characteristics during an acceleration in a running status in accordance with one embodiment.

FIG. 10 is a graph of deflection force characteristics, illustrating a relationship between control surface deflection torques and control surface deflection speeds.

FIG. 11 is a graph of motor characteristics, illustrating a relationship between torques generated by an electric motor and rotational speeds at different temperatures.

DETAILED DESCRIPTION OF PREFERRED EMBODIMENTS

With initial reference to FIGS. 1 to 8, an embodiment of a boat has a hull 10 including a transom 11. A "boat propulsion unit" is mounted to the transom 11 of the hull 10. In the illustrated embodiment, the propulsion unit is an outboard motor 12 mounted to the transom 11 via clamp brackets 13. The outboard motor 12 preferably is pivotable about a swivel shaft (steering pivot shaft) 14 that extends in a generally vertical direction.

A steering bracket 15 is fixed at the upper end of the swivel shaft 14. The steering bracket 15 is coupled at its front end 15*a* to a steering device 16. The steering device 16 is driven by operating a steering wheel 17 disposed in an operator's section of the hull 10.

A remote control device 18 preferably is disposed in the operator's section in order to adjust a propulsive force of the outboard motor 12. The outboard motor 12 is operated by operation of a lever 19 of the remote control device 18.

In the embodiment, shown in FIG. 2, the steering device 16 includes a DD (direct drive) electric motor 20 that is attached to a threaded rod 21 extending in a width direction of the boat. The motor 20 is movable in the width direction of the boat along the threaded rod 21.

The illustrated threaded rod 21 is supported at its ends by a pair of left and right supports 22. The supports 22 are supported by a tilt shaft 23.

The illustrated electric motor 20 has a coupling bracket 24 extending rearward. The coupling bracket 24 and steering bracket 15 are coupled with each other via a coupling pin 25.

As a result, as the electric motor 20 is actuated to move in the width direction of the boat relative to the threaded rod 21, the outboard motor 12 will pivot about the swivel shaft 14 via the coupling bracket 24 and the steering bracket 15. As such, the meter actuates steering of boat by rotating the motor 12.

With reference again to FIG. 1, the steering wheel 17 preferably is fixed to a steering wheel shaft 26. At the proximal end of the steering shaft 26, there is provided a steering wheel control unit 27. The steering wheel control unit 27 includes a steering wheel operation angle sensor 28 for detecting an operation angle of the steering wheel 17, and a reaction motor 29 for applying a desired reaction force to the steering wheel 17 during operation of the steering wheel 17 by the operator.

The steering wheel control unit 27 is connected to an electronic control unit (ECU) 33 via a signal cable 30. The control unit 33 is connected to the electric motor 20 of the steering device 16. The control unit 33 receives a signal from the steering wheel operation angle sensor 28, controls the electric motor 20, and controls the reaction motor 29.

The remote control device 18 preferably is disposed in the vicinity of the steering wheel 17, and is inclinable in a length direction of the boat. A position sensor 19*a* is provided in the remote control device 18 and detects the amount of operation of the operation lever 19. The amount of operation is transmitted to the connected electronic control unit (ECU) 33 via a signal cable 31. The propulsive force of the outboard motor 12 is controlled by a control device on the engine side, based on the signal. In this embodiment, the propulsive force can be controlled by adjusting a throttle opening degree, an ignition timing, an amount of injected fuel, and the like.

As shown in FIG. 4, the control unit 33 preferably includes operation status detection means 38 for detecting an operation status corresponding to an operator's steering wheel operation, running status detection means 39 for detecting a running status of the boat, outboard motor status recognition means 40 for recognizing a status of the outboard motor 12, such as its installation number, and electric motor status detection means 41 for detecting a status of the electric motor 20.

The control unit 33 also preferably includes propulsive force computation means 42 for computing a propulsive force target value to which the control unit 33 will reduce the propulsive force of the boat propulsion unit 12 when it determines that a load to the electric motor 20 during control surface deflection will increase beyond a threshold value if the propulsive force remains above the target value. This target value calculation preferably considers detection values from the operation status detection means 38. This control unit 33 also preferably includes propulsive force restraint means 43 for restraining the propulsive force of the boat propulsion unit 12 in accordance with the propulsive force target value computed by the propulsive force computation means 42.

As shown in FIG. 3, to the operation status detection means 38 there are connected: control surface deflection force detection means 53 for detecting a control surface deflection force required for control surface deflection corresponding to the operation of the steering wheel; load detection means 44 for detecting a load to the control surface; steering operation detection means 46 for detecting a steering wheel operation angle, a steering wheel operation speed and a direction in which the steering wheel is operated; and control surface deflection detection means 47 for detecting a deflection angle of the outboard motor 12, a deflection speed of the outboard motor 12 and a direction in which the outboard motor 12 is deflected, corresponding to the operation of the steering wheel. The operation status detection means 38 also is connected with deviation detection means 45 for detecting a deviation of a detected actual control surface deflection angle from a target control surface deflection angle corresponding to the steering wheel operation. The steering wheel operation angle sensor 28 provided in the steering operation detection means 46 detects a steering wheel operation angle.

The numerous "means" introduced and discussed herein comprise detectors configured to detect the associated characteristics and generate an electronic signal that is communicated to the control unit 33 and/or to another detector. Such detectors may have any suitable structure, may employ one or more sensors working alone or in concert, may include stored data, may conduct calculations based upon sensor inputs and/or stored data, and the like.

To the running status detection means 39, there preferably are connected weight detection means 48 for detecting at least one of the position of a waterline and the weight of the boat, trim angle detection means 49 for detecting a trim angle of the boat, and speed detection means 50 for detecting at least one of a speed and an acceleration of the boat, a propulsive force of the outboard motor 12, and an engine rotational speed of the outboard motor 12, as shown in FIG. 3.

Further, to the outboard motor status recognition means 40, there preferably is connected operation storage means 51 for storing therein information on the installation number of the outboard motor 12, the installation position of the outboard motor 12 relative to the boat, a rotational direction of a propeller of the outboard motor 12, a propeller size, a propeller shape, a trim tab angle, a trim tab shape, and the like. Of course, the operation storage means 51 can be included in the ECU 33.

Furthermore, the electric motor status detection means 41 preferably is connected with temperature detection means 52 for detecting a temperature of the electric motor 20. The electric motor status detection means 41 preferably stores data on an output torque or the like relative to a rotational speed and a temperature of the electric motor 20.

It is to be understood that the above-described list of means or detectors does not necessarily comprise an exhaustive list of all the detectors that can be used in embodiments of the inventions and neither does it represent a minimum list of detectors. Rather, it presents an example embodiment. It is contemplated that other embodiments may employ more or less detectors (means) and that such means may be somewhat different in configuration and in their electronic interconnections than as specifically described in this example embodiment.

With next reference to FIG. 5, operation of an embodiment will be described below.

As the operator first turns the steering wheel 17, a signal will be transmitted from the steering wheel operation angle sensor 28 in the steering operation detection means 46 to the ECU 33. Then, in step S10 of FIG. 5, a target control surface deflection angle is detected, and in step S11, a target deviation is computed.

In step S12, the operation status detection means 38 detects an operation status. As used herein, the term "operation status" refers at least to: a control surface deflection torque required for deflecting the outboard motor 12; a load to the control surface; an operation angle and operation speed of the steering wheel; a direction in which the steering wheel is operated; a rotational angle, a rotational speed, a rotational direction, a control surface deflection speed, and a control surface deflection direction of the outboard motor 12 actuated in correspondence with a steering wheel operation; a deviation of a detected actual control surface deflection angle from a target control surface deflection angle corresponding to a steering wheel operation; and the like.

The control surface deflection torque is detected by the control surface deflection force detection means 53. A load to the outboard motor 12 is detected by the load detection means 44. The operation angle and the operation speed of the steering wheel and the direction in which the steering wheel is operated are detected by the steering operation detection means 46. A rotational angle, a rotational speed, and a rotational direction of the outboard motor 12 actuated in correspondence with a steering wheel operation are detected by the control surface deflection detection means 47. A deviation of a detected actual control surface deflection angle from a target control surface deflection angle corresponding to a steering wheel operation is detected by the deviation detection means 45. Detection signals from those means are transmitted to the operation status detection means 38 to thereby detect the operation status. It is also possible to obtain the control surface deflection torque by computation.

In step S13, the running status detection means 39 detects a running status. As used herein, the term "running status" refers to at least one of the position of a waterline and the weight of the boat, at least one of a trim angle, a speed and an acceleration of the boat, a propulsive force of the outboard motor 12, and such aspects concerning operational status of the hull and motor 12 relative the surrounding body of water.

The position of a waterline and the weight of the boat are detected by the weight detection means 48. The trim angle of the boat is detected by the trim angle detection means 49. The speed and the acceleration of the boat and the propulsive force of the outboard motor 12 are detected by the speed detection means 50. The engine rotational speed is detected by a rotational speed sensor in the outboard motor 12. Detection signals from those means are transmitted to the running status detection means 39 to thereby detect and/or calculate the running status.

In step S14 the outboard motor status recognition means 40 recognizes a status of the outboard motor 12. As used herein, the term "the status of the outboard motor 12", refers to the installation number of the outboard motor 12, the installation position of the outboard motor 12 relative to the boat and/or any other outboard motor that may also be mounted to the boat, a rotational direction of the propeller of the outboard motor 12, a propeller size, a propeller shape, a trim tab angle, a trim tab shape, and the like.

Information on the installation number of the outboard motor 12, the installation position of the outboard motor 12 relative to the boat, the rotational direction of the propeller of the outboard motor 12, the propeller shape, the trim tab angle, the trim tab shape, and the like are stored in the operation storage means 51. In this embodiment, such information is read and then transmitted to the outboard motor status recognition means 40 to thereby recognize the status of the outboard motor 12.

Thereafter, in step S15, the electric motor status detection means 41 detects a status of the electric motor 20. As used herein, the term "the status of the electric motor 20" refers to a temperature and a voltage of the electric motor 20. Other motor characteristics, such as maintenance status and the like, can be detected and/or stored by this detector 41.

The temperature of the electric motor 20 is detected by the temperature detection means 52. A detection signal from the means 52 is transmitted to the electric motor status detection means 41 to thereby detect the status of the electric motor 20.

Based on such detection values, in step S16, propulsive force computation means 42 in the ECU 33 computes a propulsive force for the outboard motor 12. A deviation from the propulsive force of the running status detected by the running status detection means 39 is computed so as to set a propulsive force target value. In step S17, a signal to control/restrain the propulsive force is transmitted from the propulsive force restraint means 43 in the ECU 33 to the outboard motor 12. Then, a throttle opening degree, an ignition timing, and/or an amount of injected fuel of the engine in the outboard motor 12, and the like are adjusted to adjust and control the propulsion force to meet the target value. The process then returns to step S10.

As a result, during operation of the boat by the operator, since a propulsive force is restrained depending on a running status of the boat and the like in order to reduce a control surface deflection force to a level that can be accommodated within an advantageous performance range of the steering motor 20, a sudden change of a control surface deflection operation and an excessive control surface deflection corresponding to a steering wheel operation can be prevented. Consequently, the electric motor 20 is actuated with excellent responsiveness in substantially all conditions, and thus the operator can obtain an excellent feel of operation.

In one preferred mode of operation, a propulsive force of the outboard motor 12 is controlled depending on a steering operation status. As a control surface deflection angle becomes larger, and as a control surface deflection speed becomes higher, larger control is performed to restrain a corresponding propulsive force. In a further embodiment, when a control surface deflection operation is performed in a direction affected by a reaction force of a propeller, a control is performed to restrain a corresponding propulsive force more than in a case in which a control surface deflection is operated in the opposite direction.

As a propulsive force becomes larger, a corresponding control surface deflection force incident to steering the boat becomes correspondingly larger as indicated in the relationship between propulsive forces and control surface deflection forces shown in (b) and (c) in FIG. 6. As shown, if a deflection angle is increased, the control surface deflection force associated with a corresponding propulsive force increases from amounts shown by a solid line to amounts shown by a broken line in (b). In a preferred embodiment that considers this relationship, an increase of a control surface deflection force is restrained from increasing by reducing the propulsive force when a control surface deflection angle is increased.

Similarly, when a control surface deflection speed is increased, a control surface deflection force relative to a corresponding propulsive force is increased from amounts shown by a solid line to amounts shown by a broken line in (c). In a preferred embodiment that considers this relationship, an increase of a control surface deflection force is restrained from increasing by reducing the propulsive force when a control surface deflection speed is increased.

A broken line in FIG. 6 (*a*) shows the control surface deflection ability characteristics in one embodiment. This broken line represents the control surface deflection forces under which the control surface can be deflected in relation to control surface deflection speeds and control surface angles. As shown, when a control surface deflection angle and/or a control surface deflection speed are/is increased, the less control surface deflection force that can be handled by the steering device, and a steering operation may be out of the range of the control surface deflection ability characteristics. Such an out-of-range operation is represented by the solid line "a" in which a control surface is deflected without restraining the propulsive force. In a preferred embodiment, the propulsive force is restrained in order to restrain the control surface deflection force so that the relationship shown by the solid line "a" is changed to the relationship shown by solid line "b". As the relationship represented by line "b" is within the range of the control surface deflection ability characteristics, control surface deflection responsiveness can be ensured. Accordingly, when the control surface deflection ability characteristics are as shown by the broken line, if a propulsive force is restrained, for example, from d1 to d2 as shown in FIG. 7 (*a*), a corresponding control surface deflection force is also restrained from d1 to d2. Reducing the control surface deflection force can restore the steering system to operating within the control surface deflection ability characteristics as shown in FIG. 7 (*b*), in which control surface deflection force is reduced from e1 to e2.

As shown in FIG. 7 (*c*), when a propulsive force is not controlled, operation of the steering wheel 17 tends to yield a slow response in reaching a corresponding operation angle (control surface angle) during a period shown as a broken line in the drawing. When, on the other hand, a propulsive force is restrained in order to restrain a corresponding control surface deflection force as described above, the operation angle (control surface angle) can be promptly changed relative to time t as shown by a solid line in the drawing. Consequently, restraining propulsive force quickens steering response times.

In another preferred mode of operation, a propulsive force of the outboard motor 12 is controlled depending on a running status. A propulsive force is controlled to be small when the boat is running at a high speed, a load of the boat is heavy, a trim angle is in a trim-in position, the boat is accelerating or decelerating, and the like. If a propulsive force is increased, a control surface deflection force is increased in the relationship between propulsive forces and control surface deflection forces as shown by (b) and (c) of FIG. 8. In this relationship, if a deflection angle is increased, or if the weight of the boat, a trim angle, a running speed, and an acceleration are increased, a control surface deflection force relative to a propulsive force is increased as shown by a broken line in (b). However, even these amounts are increased, an increase of a control surface deflection force can be restrained by restraining a propulsive force.

Also, when a control surface deflection speed is increased, a control surface deflection force relative to a propulsive force is increased from amounts shown by a solid line to amounts shown by a broken line in (c). However, even if a deflection speed is increased, such increase of a control surface deflection force can be restrained by restraining a propulsive force.

A broken line in FIG. 8 (*a*) shows the control surface deflection ability characteristics, illustrating the relationship between control surface deflection forces under which the control surface can be deflected by the steering device 16 and control surface deflection speeds and control surface angles. In a case in which the boat is running at a high speed, a load of the boat is heavy, a trim angle is in a trim-in position, the boat is accelerating or decelerating, and the like, when a control surface deflection angle and/or a control surface deflection speed are/is increased, an operation may be out of the range of the control surface deflection ability characteristics as shown by the solid line "a" while a control surface is deflected without restraining a propulsive force. In such a case, the propulsive force can be restrained in order to restrain the control surface deflection force so that the relationship shown by the solid line "a" is changed to the relationship shown by a solid line "b". As the latter relationship is within the range of the control surface deflection ability characteristics, control surface deflection responsiveness can be ensured.

Further, during an abrupt acceleration such as from time t1 to time t2 as depicted in FIG. 9 (*a*) or during an abrupt deceleration from time t3 to time t4 in the same drawing, rotational speeds of the engine are changed as shown by a solid line in FIG. 9 (*a*). Accordingly, if the control surface is deflected during such an acceleration or deceleration, a control surface deflection force is abruptly increased as shown by a solid line in (b) during such an acceleration or deceleration, exceeding the range of control surface deflection ability characteristics. However, if a sudden change in a rotation speed of the engine is restrained as shown by the broken line in FIG. 9 (*a*), the abrupt increase of control surface deflection forces can be mitigated as shown by a broken line in (b). As such, the control surface deflection forces can be prevented from exceeding the range of the control surface deflection ability.

In yet another preferred mode of operation, a propulsive force of the outboard motor 12 is controlled depending on a running status. A propulsive force is controlled to be small when the installation number of the outboard motor 12 is large. Depending on a rotational direction of a propeller provided to the outboard motor 12, a reaction force from the propeller is generated in one direction. When a control surface is deflected in the direction counteracting such reaction force, a propulsive force of the outboard motor 12 is decreased more than the case in which the control surface is deflected in the opposite direction.

As to the installation position of the outboard motor 12, in a boat embodiment having a plurality of outboard motors 12, when the boat is driven with only part of the outboard motors 12 actually in operation, or when the individual outboard motors 12 are in different trim status (when the lower part of the individual outboard motor 12 has a different underwater depth), control surface deflection load characteristics will not be the same between control surface deflection to the left and control surface deflection to the right. Accordingly, a propulsive force preferably is adjusted depending on whether the outboard motor 12 generating the propulsive force is on the left side or the right side in the width direction of the boat, and/or depending on whether the outboard motor 12 has a smaller trim angle and thereby a deeper underwater depth is on the left side or the right side in the width direction of the boat (for example, the propulsive force is decreased when the control surface is returned from a deflected position to the side on which the outboard motor 12 of a deeper underwater depth is installed).

A propulsive force of the outboard motor 12 can also be controlled depending on a motor status. As the motor temperature rises, the motor characteristics described above tend to be exhibited as shown by the broken line in FIG. 11, and thus generally less torque will be outputted from the motor. Accordingly, a propulsive force from the outboard motor 12 preferably is decreased to thereby prevent exceeding the limit of the ability of the electric motor 20. In addition, in a boat with a plurality of electric motors 20, when it is driven with a small number of the electric motors 20 in operation, a propulsive force of the outboard motors 12 is decreased to thereby prevent exceeding the limit of the ability of the electric motor 20.

In the above boats, the outboard motor 12 is deflected by the electric motor 20. It is advantageous that an operation feel of the steering wheel 17 can be lighter; however, when larger torque is required for control surface deflection for example, when the operator operates the steering wheel 17 faster, output from the electric motor 20 may become less responsive, resulting in slow response of a control surface deflection operation. In this embodiment, however, in accordance with the motor characteristics of the electric motor 20, a propulsive force of the outboard motor 12 is controlled in order to restrain a control surface deflection force to thereby prevent exceeding the limit of the motor characteristics of the electric motor.

By controlling propulsion force, the outboard motor 12 is deflected within the limit of the output of the electric motor 20 by operating the steering wheel 17. Thus, a control surface deflection operation does not become slow in response.

It is a matter of course that while in the foregoing embodiment, the outboard motor 12 is used as the "boat propulsion unit," the principles discussed herein are not limited to such structure, but can also use other structures such as a sterndrive. Further, embodiments disclosed herein includes the operation status detection means 38, the running status detection means 39, the outboard motor status recognition means 40 and the electric motor status detection means 41. Other embodiments may appropriately have only one or more, of these structures.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A boat having a propulsion unit and a steering system comprising a steering wheel and a steering device, the steering device comprising an electric actuator, the steering wheel being operable by an operator and generating an actuation signal corresponding to steering wheel operation, the steering wheel being electrically connected to the electric actuator, the boat additionally comprising a controller adapted to control a propulsive force of the propulsion unit, the controller having at least one of an operation status portion adapted to obtain data concerning steering wheel operation, a running status portion adapted to obtain data concerning a running status of the boat, a propulsion unit status portion adapted to obtain data concerning a status of the propulsion unit, and an electric actuator status portion adapted to obtain data concerning a status of the electric actuator, the controller further comprising a propulsive force calculator adapted to calculate a propulsive force target based on data from at least one of the controller portions, wherein the controller is configured to reduce or restrain the propulsive force of the propulsion unit to a level at or below the propulsive force target value.

2. The boat according to claim 1, wherein the operation status portion includes at least one of a control surface deflection force detector adapted to detect a control surface deflection force necessary to deflect a control surface of the boat, a load detector adapted to detect a load on the control surface, a steering operation detector adapted to detect a steering wheel operation angle, a steering wheel operation speed and a direction in which the steering wheel is operated, a control surface deflection detector adapted to detect a control surface deflection angle, a control surface deflection speed and a direction in which the control surface is deflected, corresponding to the steering wheel operation, and a deviation detector adapted to detect a deviation of a detected actual control surface deflection angle from a target control surface deflection angle corresponding to the steering wheel operation.

3. The boat according to claim 2, wherein the running status detector portion includes at least one of a weight detector adapted to detect at least one of a position of a waterline and a weight of the boat, a trim angle detector adapted to detect a trim angle of the boat, and a speed detector adapted to detect at least one of a speed and an acceleration of the boat.

4. The boat according to claim 3, wherein the propulsion unit status portion includes an operation storage adapted to store data concerning one or more of the installation number of the propulsion unit, an installation position of the propulsion unit relative to the boat, a rotational direction of a propeller of the propulsion unit, a propeller shape, a trim tab angle and a trim tab shape.

5. The boat according to claim 4, wherein the electric actuator status portion includes a temperature detector adapted to detect a temperature of the electric actuator.

6. The boat according to claim 2, wherein the propulsion unit status portion includes an operation storage adapted to store data concerning one or more of the installation number of the propulsion unit, an installation position of the propulsion unit relative to the boat, a rotational direction of a propeller of the propulsion unit, a propeller shape, a trim tab angle and a trim tab shape.

7. The boat according to claim 6, wherein the electric actuator status portion includes a temperature detector adapted to detect a temperature of the electric actuator.

8. The boat according to claim 2, wherein the electric actuator status portion includes a temperature detector adapted to detect a temperature of the electric actuator.

9. The boat according to claim 1, wherein the running status detector portion includes at least one of a weight detector adapted to detect at least one of a position of a waterline and a weight of the boat, a trim angle detector adapted to detect a trim angle of the boat, and a speed detector adapted to detect at least one of a speed and an acceleration of the boat.

10. The boat according to claim 9, wherein the propulsion unit status portion includes an operation storage adapted to store data concerning one or more of the installation number of the propulsion unit, an installation position of the propulsion unit relative to the boat, a rotational direction of a propeller of the propulsion unit, a propeller shape, a trim tab angle and a trim tab shape.

11. The boat according to claim 10, wherein the electric actuator status portion includes a temperature detector adapted to detect a temperature of the electric actuator.

12. The boat according to claim 1, wherein the propulsion unit status portion includes an operation storage adapted to store data concerning one or more of the installation number of the propulsion unit, an installation position of the propulsion unit relative to the boat, a rotational direction of a propeller of the propulsion unit, a propeller shape, a trim tab angle and a trim tab shape.

13. The boat according to claim 12, wherein the electric actuator status portion includes a temperature detector adapted to detect a temperature of the electric actuator.

14. The boat according to claim 1, wherein the electric actuator status portion includes a temperature detector adapted to detect a temperature of the electric actuator.

15. The boat according to claim 1, wherein the propulsion unit is an outboard motor.

16. A method of steering a boat comprising a propulsion unit, a steering wheel, and a steering system comprising an electric actuator adapted to deflect a control surface to effect steering, the method comprising obtaining an actuation signal corresponding to steering wheel operation, obtaining electronic data concerning at least one of a steering wheel operation, a running status of the boat, a status of the propulsion unit, and a status of the electric actuator, calculating a propulsive force target based on the actuation signal corresponding to steering wheel operation and at least one of the electronic data, and controlling the propulsion unit so that a propulsive force of the propulsion unit is at or below the propulsive force target.

17. A method as in claim 16, wherein calculation the propulsive force target is based at least in part upon a detected temperature of the electric actuator.

18. A method as in claim 16, wherein calculation the propulsive force target is based at least in part upon whether there are a plurality of propulsion units and where on the boat the propulsion unit is positioned.

19. A method as in claim 18, wherein the propulsion unit comprises an outboard motor.

* * * * *